US007626321B1

(12) United States Patent
Gibboney, Jr.

(10) Patent No.: US 7,626,321 B1
(45) Date of Patent: Dec. 1, 2009

(54) SPRING COIL SHUNT FOR LIGHT STRING SOCKET

(75) Inventor: James W. Gibboney, Jr., Conyers, GA (US)

(73) Assignee: Tech Patent Licensing, LLC, St. Augustine, FL (US)

( * ) Notice: Subject to any disclaimer, the term of this patent is extended or adjusted under 35 U.S.C. 154(b) by 0 days.

(21) Appl. No.: 12/437,665

(22) Filed: May 8, 2009

Related U.S. Application Data

(60) Provisional application No. 61/059,914, filed on Jun. 9, 2008, provisional application No. 61/058,249, filed on Jun. 3, 2008, provisional application No. 61/058, 248, filed on Jun. 3, 2008.

(51) Int. Cl.
*H01J 5/48* (2006.01)
*H01R 33/06* (2006.01)

(52) U.S. Cl. ..... 313/318.01; 313/318.02; 313/318.09; 313/318.1; 362/644; 362/652; 362/654; 439/611; 439/612; 439/619; 439/669.2

(58) Field of Classification Search ..... 313/318.01, 313/318.02, 318.1; 362/654, 652, 644; 439/611, 439/612, 619, 699.2
See application file for complete search history.

(56) References Cited

U.S. PATENT DOCUMENTS

| | | | | |
|---|---|---|---|---|
| 3,294,932 | A | 12/1966 | Barlow | |
| 3,345,482 | A | 10/1967 | Lou | |
| 3,359,523 | A | 12/1967 | Lou | |
| 4,233,543 | A | 11/1980 | Hickok | |
| 4,350,407 | A | 9/1982 | Tong | |
| 4,644,451 | A | 2/1987 | Chabria | |
| 4,654,766 | A | 3/1987 | Tung | |
| 4,894,499 | A | 1/1990 | Hans et al. | |
| 4,991,071 | A | 2/1991 | Braasch | |
| 5,453,664 | A * | 9/1995 | Harris | 315/185 S |
| 6,113,430 | A * | 9/2000 | Wu | 439/619 |
| 6,583,536 | B1 | 6/2003 | Gibboney | |
| 6,609,814 | B2 | 8/2003 | Ahroni | |
| 6,650,065 | B1 * | 11/2003 | Shieh | 315/185 R |
| 7,261,458 | B2 | 8/2007 | Janning | |
| 7,449,643 | B2 | 11/2008 | Nakade | |
| 7,453,194 | B1 | 11/2008 | Gibboney | |
| 7,473,024 | B2 | 1/2009 | Gibboney | |

(Continued)

FOREIGN PATENT DOCUMENTS

| | | |
|---|---|---|
| GB | 1164257(A) | 6/1969 |

(Continued)

*Primary Examiner*—Sikha Roy
(74) *Attorney, Agent, or Firm*—Michael A. Mann; Nexsen Pruet, LLC

(57) ABSTRACT

A mechanical shunt for use in a socket of a string of lights resides in an otherwise typical lamp of a string of lights. The present shunt is a coiled spring shunt held by one of the electrical terminals in the socket so that it is cantilevered toward and in electrical contact with the other electrical terminal. The central portion of the spring shunt has a larger diameter. The lamp holder has bottom that, upon insertion of the holder into the socket, presses down on the central portion of the spring shunt so that its first end is moved out of electrical contact with the first electrical terminal, thereby allowing electrical current to pass through the filament in the bulb.

7 Claims, 2 Drawing Sheets

U.S. PATENT DOCUMENTS

| | | | | |
|---|---|---|---|---|
| 7,484,995 | B2 * | 2/2009 | Ding | 439/513 |
| 7,554,266 | B1 * | 6/2009 | Chen | 313/580 |
| 2002/0056622 | A1 * | 5/2002 | Yamashita et al. | 200/61.53 |
| 2003/0156412 | A1 | 8/2003 | Limber et al. | |
| 2003/0214212 | A1 | 11/2003 | Gibboney, Jr. | |
| 2006/0172613 | A1 * | 8/2006 | Sasaki | 439/824 |
| 2006/0207866 | A1 | 9/2006 | Bonn et al. | |
| 2007/0001058 | A1 | 1/2007 | Severson | |
| 2007/0266970 | A1 * | 11/2007 | Ogawa | 123/90.15 |
| 2007/0297196 | A1 | 12/2007 | Massabki et al. | |
| 2008/0129176 | A1 | 6/2008 | Jigamian | |
| 2008/0130284 | A1 | 6/2008 | Altamura et al. | |
| 2008/0160899 | A1 * | 7/2008 | Henry et al. | 454/184 |

FOREIGN PATENT DOCUMENTS

| | | |
|---|---|---|
| JP | 200619624(A) | 7/2006 |

* cited by examiner

SPRING COIL SHUNT FOR LIGHT STRING SOCKET

CROSS REFERENCE TO RELATED PATENTS

The priority benefit of U.S. provisional patent application Ser. No. 61/059,914, filed Jun. 9, 2008, which is incorporated herein in its entirety by reference, is claimed. The present application is related to U.S. provisional applications 61/058,249 filed Jun. 3, 2008, 61/058,248 filed Jun. 3, 2008; and U.S. non-provisional application Ser. Nos. 12/133,800 filed Jun. 5, 2008, and 12/134,528 filed Jun. 6, 2008, in that all four applications are commonly owned and are directed to related subject matter.

BACKGROUND OF THE INVENTION

The present invention relates to light strings such as are used for holiday lighting, and in particular to mechanical shunts for passing electrical current to the next light in the string if the bulb is loose or missing.

Strings of lights are typically wired electrically in series. Consequently, when one light in the string burns out or is removed, all the lights in the string go out. Determining which light needs to be replaced is tedious. If the string has 50 or more lights and the string is attached to a Christmas tree, finding the burned out or missing bulb can be very tedious.

For a number of years, this problem has been solved, or at least avoided, by the use of shunts that allow current to pass directly between the terminals of the defective lamp, bypassing the missing or defective bulb filament. Passing electrical current from one lamp to the next regardless of the condition of the bulb in any individual lamp allows the remaining lamps to continue to operate.

Shunts are typically found in two places in prior art lamps, namely, in the glass globe and in the socket. The shunts inside the glass globe are typically made of wire wrapped around the conductive elements (called Dumet wires). When the filament fails, the oxide coating on the wires that theretofore prevented direct conduction of electricity is burned off and the coil welds itself to the Dumet wires, thereby providing a new electrically conductive path for passing the electrical current.

Of the shunts that are located in the socket, there are two types, namely, solid state shunts and mechanical shunts. Among the mechanical shunts, for example, there is a set of spring contact terminals that is the subject of U.S. Pat. No. 6,257,740. These spring contacts are pushed apart when the lamp base is inserted into the socket and spring back together when the base is removed, thereby allowing the current to pass from one terminal to the other directly. This type is strictly for use when the bulb (and its base) is removed and does not address the issue of a burned out bulb. This type of shunt works well and has enjoyed commercial success.

Another mechanical shunt is disclosed in U.S. Pat. No. 7,253,556, which is invented by the present inventor and is commonly owned by applicant. This mechanical shunt is a nearly horizontal flat strip of metal held in place between the two electrical terminals in a light socket by a shunt holder. The ends of the shunt extend laterally and slightly downwardly to engage the electrical terminals mounted to the socket wall. When the lamp base, which is hollow, is inserted into the socket, the shunt holder together with its shunt is received inside the hollow base, and, as the shunt enters the base, its lateral ends are bent down and away from the electrical terminals on the socket wall, thereby allowing electrical current to pass to and through the Dumet wires and thence to the filament in the bulb rather than directly through the shunt between the electrical terminals.

U.S. Pat. No. 6,609,814 issued to Ahroni teaches an asymmetrical mechanical shunt composed of two portions that are nearly co-planar with the bottom of one portion contacting the top of the other portion. Each of these two portions of the shunt are in electrical contact with one of the electrical terminals mounted on the wall of his socket. When a lamp holder is inserted into the socket, it presses a first of the two portions down and thus out of engagement and electrical connection with the second of the two portions of the shunt. The first portion resiliently resumes electrical contact with the second portion once it is freed to resilient spring back into engagement by the removal of the lamp holder from the socket.

Manufacturers of miniature lamps are concerned with cost of materials and labor. Small lamps are assembled largely by hand. Accordingly, small components that need to be added to the socket increase labor costs as well as material costs. While individually their cost is trivial, the cumulative cost for materials and labor of the huge number of miniature lights made and sold every year in a competitive marketplace collectively is substantial. Correspondingly, even small changes that, for example, reduce material requirements, simplify manufacturing, or improve safety or reliability, make a huge difference in the costs to manufacture.

Another concern regarding shunts in light sockets is the requirement of most shunts to receive only one type of holder, namely, one that works with the shunt, typically to activate it or manipulate it in some fashion. In many applications, the user may wish to place a special decorative device in the socket for power to illuminate it or cause some small component of the ornament to move. These include, for example, the so-called pigtail ornaments, such as that described in U.S. Pat. No. 6,764,205, issued to Peloquin. This type of ornament contains a light that is connected to a cord (or "pigtail") the distal end of which is inserted into a socket of a light string for its source of electrical power for the light in the ornament. Because the connector on the end of the pigtail does not have and special structure needed to activate the mechanical shunt, these types of ornaments are then operating without the shunt protection or the distal end will not fit properly into the socket. This presents a dilemma for the user. If such an ornament is used, the shunt will often be inoperable or will always be operable, even when the ornament is in the socket.

Finally, particularly in the case of lights used out of doors, when temperatures increases during the day cause the sockets of lights strings to expand, the lamp holders will tend to come out of their sockets, particularly if the lamps are attached to a support or tree so that they are hanging down. Under these circumstances, a mechanical shunt becomes all the more important to keep the remaining lamps burning and to allow those responsible for the light to quickly find the missing lamps in the string. Accordingly, there remains a need for a better mechanical shunt for use in the sockets of the lamps of light strings.

SUMMARY OF THE INVENTION

According to its major aspects and briefly recited, the present invention is a mechanical shunt for use in the sockets of a light string. When the bulb is missing from the socket, the shunt directs the current flow to the next light in the string of lights.

A lamp with the present shunt is typical-looking from the exterior. Furthermore, the present bulb and holder are similar to prior art bulbs and holders, with a filament and a pair of Dumet wires extending from inside the bulb to the outside where they pass through spaced-apart holes formed in the bulb holder. Moreover, carried on the interior wall of the socket are two opposing conducting terminals? However, in the present invention, one of the two conducting terminals has a small hole formed therein dimensioned to receive one end of a spring shunt; the other may have a hole if it is desired that both terminals be the same but only one needs to have a hole in it. That end of the shunt is inserted far enough into the hole so that the other end of the spring is held fast and cantilevered across the interior of the socket toward the opposing side, and is long enough to engage the second conducting terminal physically, provided that the lamp and its holder are not present, so that the spring shunt can conduct electricity to the terminal. The shunt spring, which is preferably a coil of conductive wire, has a smaller diameter end portions and a larger diameter center portion. If the holder is inserted into the socket, the larger diameter center portion engages the bottom of the holder, and is pressed down when the holder is inserted into the socket, thereby deflecting one end away from the first electrical terminal on the socket wall and out of engagement with the conducting terminal so that electrical current can pass from that first conducting terminal through the first Dumet wire to the filament inside the bulb and back through the second Dumet wire to the second conducting terminal.

An important advantage of the present invention is the simplicity of its manufacture. There is one extra step beyond the assembly of a typical, prior art, "shuntless" lamp. One end of a symmetric spring is inserted into a hole in one of the terminals before that terminal is inserted into the socket as usual.

Another important feature of the present shunt is that the holder can be inserted in either orientation and can be replaced with a special ornament without either losing the function of the shunt because it is never closed or having the shunt prevent operation because it is always closed Still another feature of the invention is the use of a mechanical shunt that has a large, coiled central portion preferably made of high nickel stainless steel. The large coil obviates not only the need for a special lamp holder to engage it, as the bottom of any lamp holder will engage and deflect the present shunt, but, when not being deflected by the holder, the coil keeps constant contact against the electrical terminal notwithstanding changes in the physical dimension of the socket as a result of thermal expansion. The end of the coil also scrapes against the electric terminal when the holder deflects it on insertion into the socket and again when the holder is removed from the socket, thereby keeping the terminal clean for good electrical contact. The high nickel stainless steel has practically no galvanic interaction with the copper electrical terminals.

These and other features and their advantages will be apparent to those skilled in the art of light string electrical design from a careful reading of the Detailed Description of Preferred Embodiments accompanied by the following drawings.

DETAILED DESCRIPTION OF THE INVENTION

The present invention is a lamp with a mechanical shunt for use in a string of lights. The shunt, when activated by the removal of the lamp and its holder shifts the flow of the electrical current from a first path leading from electrical terminals in the lamp socket through two Dumet wires to a filament in the bulb, to a second path that bypasses the Dumet wires and filament and flows from the terminals directly through the shunt. The term "light string" refers to plural spaced-apart lamps interconnected in an electrical series by insulated electrical wiring. The term "lamp" refers to the combination of a bulb, holder and socket.

Figure 1:
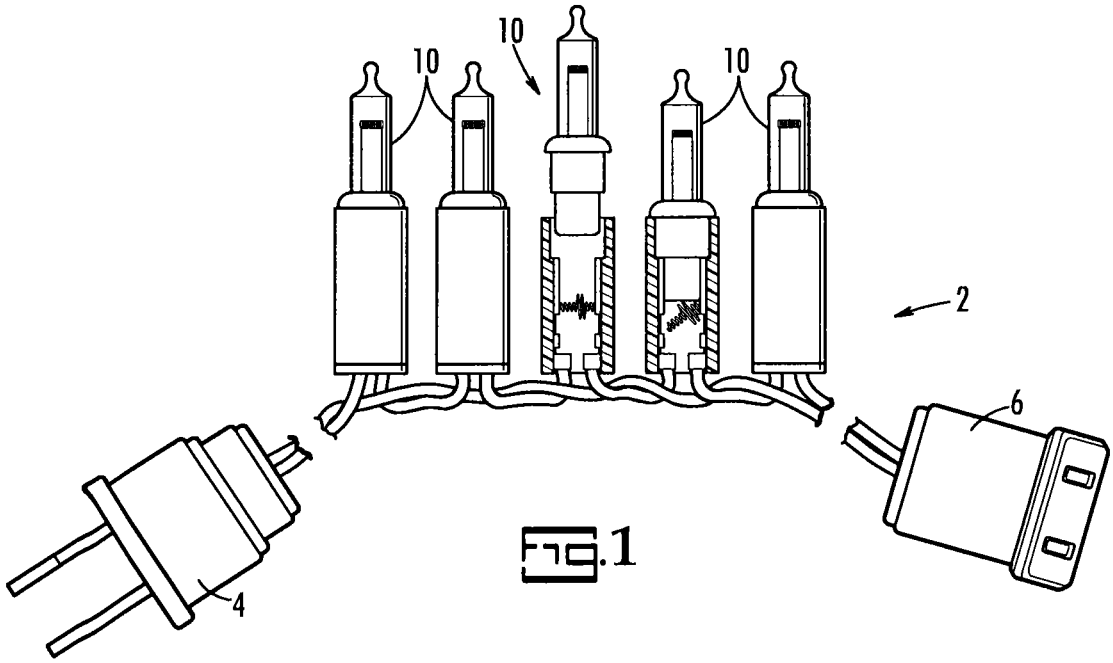
FIG. 1 shows a light string with two lamps of the string having sockets partially cut away and one of these having the bulb and its holder being removed from the partially cut away socket.
Figure 2:
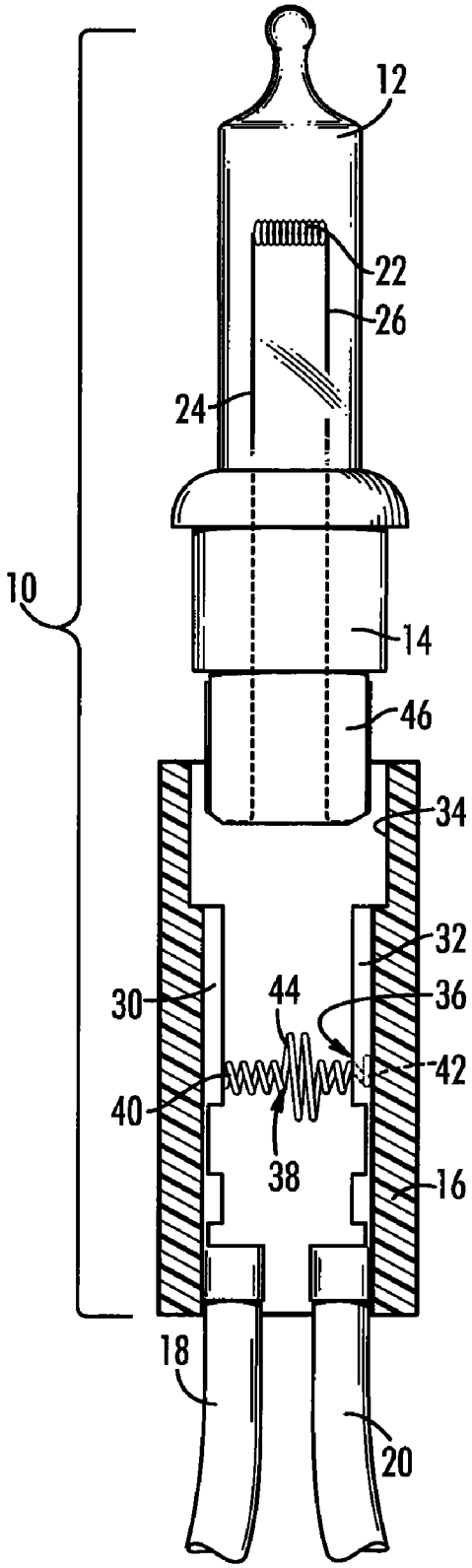
FIG. 2 is a side view of the present lamp with bulb and base in their socket, and the socket shown in cross section to reveal the shunt mechanism in an electrically open position as a result of the insertion of the lamp base, according to a preferred embodiment of the present invention.
Figure 3:
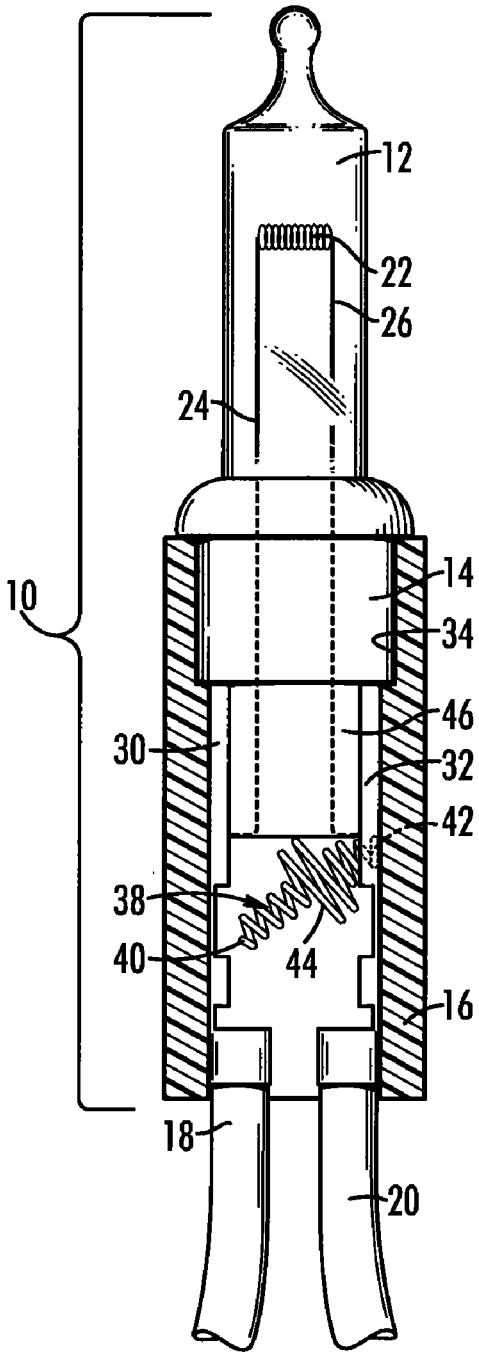
FIG. 3 is a side view of the present lamp with bulb and base partially removed from their socket, and the socket shown in cross section to reveal the shunt mechanism in its electrically conducting position, according to a preferred embodiment of the present invention.

FIG. 1 illustrates a light string 100 including a plug 4 at one and, a receptacle 300 at the opposing end and plural lamps 10 therebetween all connected in an electrical series by two insulated wires 18, 20. Two lamps 10 are shown partially cutaway to illustrate the present shunt. In one of them a bulb 12 and its holder 14 are removed from a socket 16 to activate the present shunt. FIGS. 2 and 3 illustrate show these two lamps 10 in detail.

FIG. 2 shows a lamp 10, in a side view. Lamp 10 includes a bulb 12, a holder 14 and a socket 16. In FIG. 3, bulb 12 and holder 14 are shown seated in socket 16, with socket 16 shown in cross-section. Two insulated electrical wires, a first insulated wire 18 and a second insulated wire 20, extend into socket 16 from the adjacent lamps in the series of lamps of the light string (not shown). Bulb 12 is a partially evacuated transparent housing with a filament 22 connected between a first and an opposing, second Dumet wire 24, 26 inside bulb 12. Dumet wires 24, 26, however, extend from the interior of bulb 12 to its exterior and through two spaced-apart holes formed in holder 14. Once emerging from the holes in holder 14, Dumet wires 24, 26 are folded back against the sides of holder 14 in order to be in position along the sides of holder 14 so as to make contact with a first and an opposing, second electrical terminal 30, 32, carried on opposing sides of the interior wall 34 of socket 16, as holder 14 is slid into socket 16.

Within socket 16, first and second electrical terminals 30, 32, are in electrical contact with first and second insulated wires 18, 20, respectively. When lamp holder 14 is seated in socket 16, Dumet wires 24, 26, also contact first and second terminals 30, 32, both physically and electrically, thereby allowing, when first and second insulated wires 18, 20, are energized, the flowing of an electrical current in a first conductive path through first and second terminals 30, 32, first and second Dumet wires 24, 26, and filament 22.

Second electrical terminal 32 has a hole 36 formed therein; first electrical terminal 30 does not need a hole but may have a hole formed therein if it is an advantage in manufacturing for first and second terminals 30, 32, to be identical. A spring shunt 38 may be formed with a central portion 44 in the form of a coil of wire between two smaller diameter end portions. Spring shunt 38 runs from second electrical terminal 32 toward first electrical terminal 30 across the interior of socket 16. Central portion 44 may have a larger cross section than its end portions. If spring shunt 38 is a coil of wire, central portion 44 has a larger diameter than its end portions. Spring shunt 38 has a first end 40 and an opposing second end 42. Second end 42 is inserted far enough into hole 36 of second electrical terminal 32 to be held fast in a cantilevered relationship across the interior socket 16, extending toward the opposite side of wall 30 and is held by second electrical terminal 32 in electrical contact with first electrical terminal 30 when holder 14 is not in socket 16.

Holder 14 has a bottom 46 that is standard in shape; that is, it needs no special structure extending downward from holder 14 and intended to engage central portion 44. Any standard lamp holder including holders on commercially available replacement lamps 10 will suffice. Center portion 44 has a larger cross section so as to meet bottom 46 as holder 14 is inserted and be deflected out of electrical contact with first terminal 30. As holder 14 is inserted into socket 16, Dumet wires 24, 26, come into electrical contact with first and second electrical terminals 30, 32 as bottom 46 of holder 14 bends center portion 44 of spring shunt 38 down thereby forcing first end 40 of spring shunt 38 away from first electrical terminal 30 and breaking the electrical contact that otherwise bypasses filament 22 and allowing current to flow to first electrical terminal then to first Dumet wire 24, to filament 22 to second Dumet wire 26 and thence to second electrical terminal 32. Likewise, removal of holder 14 withdraws bottom 46 from socket 16 allowing first end 40 of spring shunt 38 to resiliently return to contact with first electrical terminal 30 prior to Dumet wires 24, 26, breaking electrical contact with first and second electrical terminal 30, 32 (and incidentally scraping first electrical terminal 30 both on removal of holder 14 and its reinsertion, to clean first terminal 30 and thus assure good electrical contact between holder 14 and first electrical terminal 30). Accordingly, the present spring shunt 38 does not require a holder 14 with a specially formed lower portion 46 and can accommodate the so-called pigtail and other ornaments when used in place of a bulb and holder.

It is also important to prevent arcing when lamp holder 14 is removed from socket 16. Arcing is avoided by selection of the geometric relationships among the specific location of first end 40 of spring shunt 38 and lower portion 46 with respect to first electrical terminal 30. Lower portion 46 does not break contact between first end 40 of spring shunt 38 until first Dumet wire 24 makes contact with first electrical terminal 30. Similarly first end 40 of spring shunt 38 make contact with first electrical terminal before first Dumet wire 24 breaks contact with first electrical terminal. Thus, arcing is avoided in the insertion and withdrawal of holder 14 from socket 16 as the new electrical current path is established before the old one is broken. On insertion of holder 14, the new path is from first and second electrical terminals 30, 32 through Dumet wires 24, 26; on removal of holder 14, the new path is from first and second electrical terminals 30, 32 through spring shunt 38.

The hole in second electrical terminal 32 for spring shunt 38 may be a slot formed by a short cut made in second electrical terminal 32 one side of which is pushed outwardly to form an opening large enough for the end of spring shunt 38 to be inserted. Spring shunt 38 can be turned a few times to advance it into second electrical terminal 32 far enough to be securely held. Then the opening can be pushed back against spring shunt 38 in a "gas fit" to unify spring shunt 38 and second electrical terminal in such a way that oxidation corrosion between the two is minimized.

Spring shunt 38 is preferably made of coiled, high nickel stainless steel, such as austenitic steel. First and second electrical terminals 30, 32 are typically made of brass and, high nickel stainless steel has a galvanic potential very similar to that of copper. Accordingly, contact by spring shunt 38 with first and second electrical terminals 30, 32, does not produce appreciable corrosion. The compression of spring shunt 38 helps to assure good electrical contact with first electrical terminal 30 notwithstanding dimensional changes of socket 16 such as result from thermal expansion when used out of doors where it may be exposed to the sun during the day.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A lamp for use in a light string, said lamp comprising:

a bulb;

a filament in said bulb;

a holder carrying said bulb, said holder having two spaced-apart holes formed therein said holder having a bottom;

a first and a second Dumet wires extending from said filament inside said bulb through said two spaced-apart holes in said holder to the exterior of said holder;

a socket carrying said holder, said holder removably seatable in said socket, said socket having an interior wall;

a first and an opposing second electrical terminal carried by said interior wall of said socket, said first and said second Dumet wires engaging said first and said second terminals, respectively, when said holder is seated in said socket;

a spring shunt having a first and a second end and formed of two end portions with a central portion therebetween, with said central portion having a larger cross section than said two end portions, said second end of said spring shunt being carried by said second electrical terminal so that said spring shunt is cantilevered across said interior of said socket toward said first electrical terminal, said bottom of said holder pressing down on said central portion of said spring shunt so that said first end of said spring shunt is thereby moved out of electrical contact with said first electrical terminal when said holder is in said socket and said spring shunt returning resiliently to electrical contact with said first terminal so that said spring shunt passes electrical current between said first and said second terminals when said bottom of said holder is no longer pressing down on said spring shunt.

2. The lamp as recited in claim 1, wherein said second terminal has a hole formed therein and wherein said second end of said spring shunt is inserted into said hole and thereby held fast by said second terminal.

3. The lamp as recited in claim 1, wherein said central portion of said spring shunt is a coiled spring.

4. The lamp as recited in claim 1, wherein said spring shunt is a coiled spring.

5. The lamp as recited in claim 1, wherein before said bottom of said holder moves said spring shunt out of electrical contact with said first electrical terminal, said first and second Dumet wires move into electrical contact with said first and second electrical terminals, respectively.

6. The lamp as recited in claim 1, wherein said first end of said spring shunt returns resiliently into electrical contact with said first terminal before said first and second Dumet wires break contact with said first and second electrical terminals, respectively.

7. The lamp as recited in claim 1, wherein said spring shunt is made of high nickel stainless steel.

* * * * *